US006220469B1

(12) United States Patent
Basseches

(10) Patent No.: US 6,220,469 B1
(45) Date of Patent: Apr. 24, 2001

(54) ANTISTATIC FLOTATION BODY AND PONTOON CONTAINING SUCH BODY

(76) Inventor: Alexandre F. Basseches, 125 E. 87 St., Apartment 6D, New York, NY (US) 10128

( * ) Notice: Subject to any disclaimer, the term of this patent is extended or adjusted under 35 U.S.C. 154(b) by 0 days.

(21) Appl. No.: 09/198,197

(22) Filed: Nov. 23, 1998

Related U.S. Application Data

(60) Provisional application No. 60/089,915, filed on Jun. 19, 1998.

(51) Int. Cl.[7] ..... B65D 88/34
(52) U.S. Cl. ..... 220/216
(58) Field of Search ..... 220/216, 218, 220/221, 222, 226

(56) References Cited

U.S. PATENT DOCUMENTS 1,590,877 * 6/1926 Black ..... 220/216
2,907,923 * 10/1959 Short ..... 220/216
3,346,138 * 10/1967 Tubbs ..... 220/216
3,366,266 * 1/1968 Heartstedt ..... 220/216
3,401,818 * 9/1968 Hagen ..... 220/216
3,687,329 * 8/1972 Baum ..... 220/216
3,998,204 * 12/1976 Fuchs et al. ..... 220/218
4,329,918 * 5/1982 Kuhtreiber ..... 220/216 X
5,320,887 * 6/1994 Moss et al. ..... 428/35.7

* cited by examiner

*Primary Examiner*—Stephen K. Cronin
(74) *Attorney, Agent, or Firm*—David M Warren

(57) ABSTRACT

A hollow plastic body, particularly a plastic ball, has antistatic properties and a melting temperature above that found in floating covers of petrochemical storage tanks, therefore, enabling use of the body in flotation of oil tank covers without danger of melting and without danger of developing a static charge followed by subsequent hazardous discharge. The balls are constructed of a non-foamed high-density plastic resin, HDPE (high density polyethylene), mixed with an antistatic additive or agent. The antistatic agent is effective to convert the electrically insulating plastic to an electrically conductive material which does not develop a static electrical charge. Only a relatively small amount of the antistatic agent, less than one percent by weight, is sufficient to provide the desired antistatic property to ball while having no more than a minimal effect on the melting temperature, thereby to retain the integrity of the flotation in the presence of the elevated temperature.

7 Claims, 1 Drawing Sheet

ANTISTATIC FLOTATION BODY AND PONTOON CONTAINING SUCH BODY

RELATED APPLICATION

This application is based on and claims right of priority in a provisional patent application having Ser. No. 60/089,915 filed Jun. 19, 1998, the contents of which are incorporated herein in its entirety.

BACKGROUND OF THE INVENTION

This invention relates to the manufacture of an antistatic ball and its use as flotation in a cover of a tank holding flammable liquid.

Balls, particularly light weight balls of plastic, are employed in numerous situations ranging from children's toys to flotation in industrial equipment. Hollow balls, be they of thin walled metallic or plastic material, have excellent flotation characteristics. Plastic balls are preferred for flotation due to ease of manufacture and resistance to corrosion.

A situation of considerable interest in the use of flotation in the construction of tanks containing flammable or explosive liquid, such as an oil tank in a tank farm as found in the petrochemical industry. One form of construction of such a tank is the provision of a circular cylindrical sidewall open at the top, and being closed off by a cover which floats on liquid contained within the tank. The cover is constructed with pontoons which enable the cover to float. It is well known that such tanks may require maintenance after an extended period of use, particularly with respect to insuring the integrity of the flotation employed in the cover. Access ports, large enough to admit entry of a person, are provided at the top of each of the pontoons to an able the person to enter the pontoon to inspect the pontoon.

Generally, the cover is fabricated of metal and has a hollow chamber divided by walls into an array of pontoons to provide sufficient flotation to carry the weight of the cover plus additional weight, such as the weight of snow which might be on the cover. In older oil tank equipment, the cover was constructed of a metal plate with the pontoons mounted beneath the cover plate, while modem tanks have the pontoons located above the metal cover plate. Repairs to the cover may require welding equipment which can be used only after the tank has been taken out of service so as to insure that the cover is clean and that there are no flammable vapors present. If any flammable vapors be present during repair work on the cover, such as the repair of a pontoon of the cover, a spark from the welding may ignite an explosive burning of the vapor.

Repairs may be made also without taking the tank out of service. For example, one of the pontoons, may have sustained a relatively small opening through which liquid can seep resulting in a loss of buoyancy. By means of the access port a person may enter the pontoon and apply foamed urethane plastic as a liquid which later hardens to maintain buoyancy. Use of the plastic is not intended as a permanent repair because the plastic may become impregnated with the flammable liquid. Also, the plastic is disadvantageous because, at the conclusion of the service interval when reconditioning is mandatory, it is very difficult to remove the plastic so as to be able to clean the cover and make any permanent repairs. Clearly, welding cannot be employed for repair until all liquid and liquid soaked flotation, such as the foamed plastic, has been removed.

As an alternative procedure of repair, one might consider insertion in the pontoons of hollow non-foamed plastic bodies to provide sufficient buoyancy so that it is not necessary to repair the leak in the pontoon. However, the use of a plastic hollow body, such as a hollow ball, has been avoided in the petrochemical industry because such a plastic body is electrically insulating and susceptible to developing a static electric charge. There is a danger that the flotation body may suddenly discharge via a spark which can ignite an explosion.

SUMMARY OF THE INVENTION

The foregoing danger is overcome and other advantages are provided by the construction of a hollow plastic body, particularly a plastic ball, which has antistatic properties and, therefore, can be used in flotation of oil tank covers without danger of developing a static charge followed by subsequent hazardous discharge. The balls are constructed, in accordance with the invention, of a non-foamed high-density plastic resin, HDPE (high density polyethylene), mixed with an antistatic additive or agent. The antistatic agent is effective to convert the electrically insulating plastic to an electrically conductive material which does not develop a static electrical charge. In this sense, the antistatic plastic balls may be likened to metallic balls, but without danger of corrosion and with greater facility of manufacture. In a preferred embodiment of the invention, the balls are hollow and are formed by a process of blow molding. It is noted also that, if desired, the balls can be used for purposes other than flotation, including use by children as a toy.

In accordance with a feature of the invention, it is noted that the antistatic agent has a melting point, and the HDPE plastic has a melting point higher than the melting point of the antistatic agent. Mixing of the plastic resin with the antistatic agent produces a resultant plastic material wherein the melting point has been reduced from the melting point of the plastic. In the use of the invention in the construction of a tank cover of an oil-storage tank on a tank farm, elevated temperatures are experienced due to a heating of the tank by rays of the sun. The melting point of the HDPE plastic is well above environmental temperatures experienced on the tank farm so as to insure integrity of the flotation in the tank cover. However, use of an excessive amount of the antistatic agent in the mixture can produce a resultant plastic material having too low a melting temperature such that the integrity of the flotation can no longer be assured in the presence of intense heating of the tank by the sun's rays. It is observed in the practice of the invention that only a relatively small amount of the antistatic agent, less than 10 percent or even less than one percent by weight, is sufficient to provide the desired antistatic property to the flotation body or ball. Such a small fraction of the antistatic agent in the final plastic material has no more than a minimal effect on the melting temperature, thereby to retain the integrity of the flotation in the presence of the elevated temperature.

BRIEF DESCRIPTION OF THE DRAWING

The aforementioned aspects and other features of the invention are explained in the following description, taken in connection with the accompanying drawing figures wherein.

Identically labeled elements appearing in different ones of the figures refer to the same element but may not be referenced in the description for all figures.

DETAILED DESCRIPTION OF THE INVENTION

Figure 1:
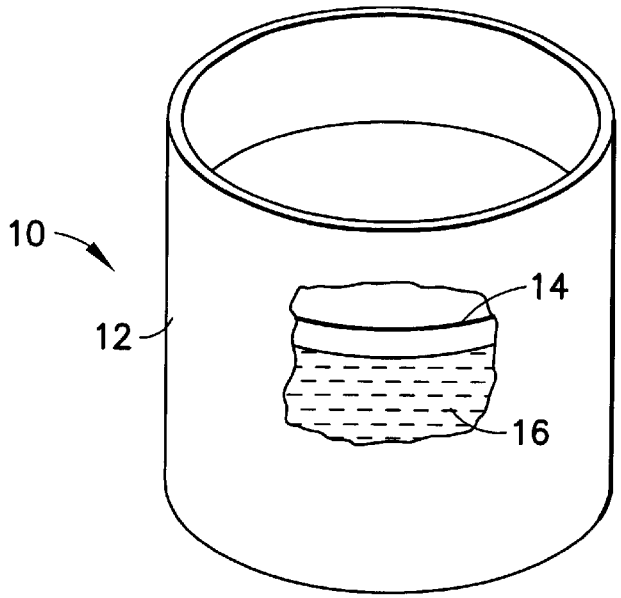
FIG. 1 shows a tank for storage of liquid with a tank cover of the invention floating on the surface of the liquid.

With reference to FIG. 1, a tank 10 comprises a sidewall 12 and a roof or cover 14. The tank stores liquid 16 shown in a cutaway portion of the sidewall 12. The cover 14 floats on the top surface of the liquid 16. While any liquid may be stored in the tank 10, the invention is particularly useful in the case of storage of a flammable liquid such as a petroleum based product.

Figure 2:
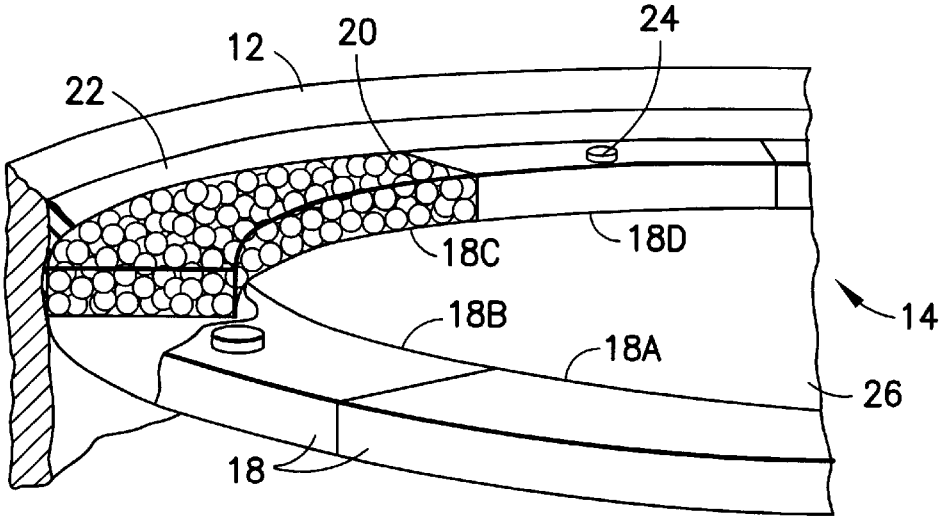
FIG. 2 shows a stylized fragmentary view of a portion of the cover, wherein parts of a tank wall and the cover are cut away to show flotation.

As shown in FIG. 2, and in accordance with the invention, the cover 14 comprises pontoons 18 filled with flotation bodies, preferably balls 20, which are fabricated of an antistatic plastic material. The antistatic plastic material inhibits development of static electrical charges which may develop upon a rubbing of one ball against another ball, and the possible discharge via a spark which could ignite explosive vapors of the liquid 16. A weather shield 22 is disposed about a perimeter of the cover 14, and is located between the cover 14 and an interior surface of the sidewall 12 to insure separation of the external environment from the internal environment of the tank 10 during vertical displacement of the cover 14 accompanying a change in level of the liquid 16. Each of the pontoons 18 is provided with an access port 24 through which balls 20 may be placed within or removed from the pontoon 18. The pontoons 18 are located on the top surface of a base plate 26 of the cover 14. Each of the pontoons 18 is fabricated as a rigid hollow metallic shell defining an inner space for reception of the flotation bodies. The base plate 26 is fabricated of metal as is the sidewall 12 of the tank 10. While only a few of the pontoons 18 are shown in FIG. 2, it is to be understood that the array of the pontoons 18 completely encircles the cover 14.

To facilitate description of the cover 14, individual ones of the pontoons 18 are further identified as pontoons 18A, 18B, 18C, and 18D. In the stylized view of FIG. 2, the pontoon 18B is partially cut away, and the pontoon 18C is shown with transparent walls allowing a viewing of the balls 20 within the pontoon 18C. An empty pontoon 18 would have great buoyancy, however, a slight hole in the shell of the pontoon 18 will admit the liquid which will tend to sink the pontoon 18. Therefore, it is the practice to fill the pontoon with flotation bodies which impart sufficient buoyancy to the pontoon even if the pontoon leaks.

The density of the flotation must be less than the density of the liquid in order to provide buoyancy to the cover. Accordingly, if the density of the plastic material of the flotation is substantially less than that of the liquid, it may be possible to use solid flotation bodies. However, in the general case wherein a relatively low density liquid, such as petroleum, is being stored in the tank, and wherein the cover itself has significant weight, the flotation bodies, be they spherical or other shape, are hollow to provide the necessary buoyancy.

In the manufacture of the balls 20, the HDPE plastic material of the balls is non-foamed, as compared to foamed material which is disadvantageous in flammable environments because of its capacity to absorb hazardous liquid. The HDPE resin is mixed with an additive, namely the antistatic agent, prior to the operation of molding the balls 20. Commercially available antistatic agents have proven to be successful in the fabrication of the balls 20, three antistatic agents being as follows: such antistatic agents being as follows: (1) GLYCOSTAT, an antistatic agent combinable with plastic material, provided by Lonza of Fair Lawn, N.J.; (2) ZELEC, an antistatic agent composed of fatty alcohol phosphate and being combinable with plastic material, provided by DuPont of Wilmington, Del.; and (3) WITCONOL, an antistatic agent composed of mono and diglycerides from edible meat fat and being combinable with plastic material, provided by Witco of Greenwich, Conn.

The manufacture continues with the molding of the balls from the mixture of the plastic resin with the antistatic agent. Even though the balls 20 are fabricated of high density plastic material, the mixture of HDPE with antistatic agent, the process of manufacture is the same as a process which has been employed for fabrication of spherical bodies of low density plastic, in particular, the blow-molding manufacturing process disclosed in Moss et al, U.S. Pat. No. 5,320,887. The resulting balls 20 are hard and are pressurized to retain their shape, even under pressure from the weight of the cover 14.

The melting points of various different additives vary from 60° C. to 70° C. The HDPE has a melting point of 110° C. The temperature within a pontoon 18 may reach 180° F. Since the additive lowers the melting point of the HDPE, it is necessary to control the amount of the additive to insure that there is no excessive reduction of melting point with danger of failure of the flotation body if the melting point of the mix is less than or approximately equal to the foregoing pontoon temperature. Fortunately, it has been found that the requisite antistatic property of the flotation body can be obtained with such small amounts of the additive that the resulting drop of melting point is inconsequential.

By way of example in the wide range of amount of additive that can be combined with the plastic to attain the requisite antistatic property, testing has shown a range from a mixture of 0.01% additive with 99.99% HDPE by weight to a mixture of 40% additive with 60% HDPE by weight. However, the latter mixture produced a melting temperature which is much lower than that of the HDPE, namely an excessively low value of 166° F., while the former mixture introduced no more than an inconsequential reduction of melting temperature. Therefore, a flotation body made of the former mixture has adequate antistatic property and adequate resistance to melting in the elevated temperature of the pontoon.

It is to be noted that the principles of the invention, described above with respect to a flotation body of high-density plastic, herein HDPE, apply also to flotation bodies fabricated from other non-foamed plastic materials which may develop static electric charge in the presence of a rubbing among the bodies.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A pontoon-supported cover for covering a flammable liquid, comprising:

a cover plate, a series of pontoons located on the plate, flotation disposed in the pontoons, and access ports in respective ones of the pontoons for admission and replacement of the flotation;

wherein said flotation comprises multiple bodies of high density non-foamed plastic material, and the plastic material includes a mix of plastic with antistatic material to inhibit development of static electric charge.

2. A cover according to claim 1 wherein the flotation bodies are balls, and a peripheral region of the cover is configured for contact with an encircling wall of a tank containing the flammable liquid.

3. A cover according to claim 1 wherein the flotation bodies are hollow, and a peripheral region of the cover is configured for contact with an encircling wall of a tank containing the flammable liquid.

4. A cover according to claim 1 wherein the flotation bodies are hollow balls, and a peripheral region of the cover is configured for contact with an encircling wall of a tank containing the flammable liquid.

5. A cover according to claim 1 wherein a peripheral region of the cover is configured for contact with an encircling wall of a tank containing the flammable liquid; and the antistatic material has a melting temperature and the plastic has a melting temperature higher than the melting temperature of the antistatic material.

6. A cover according to claim 5 wherein, in any one of the flotation bodies, the ratio of weight of the antistatic material to the weight of the body is less than 10 percent to inhibit a reduction of a melting temperature of the plastic material from the melting temperature of the plastic.

7. A cover according to claim 5 wherein, in any one of the flotation bodies, the ratio of weight of the antistatic material to the weight of the body is less than one percent to inhibit a reduction of a melting temperature of the plastic material from the melting temperature of the plastic.

* * * * *